US005788367A

United States Patent [19]

Budaev et al.

[11] Patent Number: 5,788,367

[45] Date of Patent: Aug. 4, 1998

[54] PNEUMATIC VIBRATOR

[75] Inventors: Jury Alexeevich Budaev, ul.Baykalskaya, d.224,kv.13; Viktor Konstantinovich Kazantsev; Jury Petrovich Shelkovnikov; Viktor Grigorievich Shishmarev, all of Irkutsk; Igor Samsonovich Grinberg, Irkutskaya obl.; Sergey Arkadievich Kokhanovsky, Irkutskaya obl.; Vladimir Iliich Skornyakov, Irkutskaya obl.; Petr Ivanovich Elagin, Irkutskaya obl., all of Russian Federation

[73] Assignee: Jury Alexeevich Budaev, Irkutsk, Russian Federation

[21] Appl. No.: 761,244

[22] Filed: Dec. 6, 1996

[30] Foreign Application Priority Data

Dec. 13, 1995 [RU] Russian Federation ..... 95120801
Dec. 13, 1995 [RU] Russian Federation ..... 95121043

[51] Int. Cl.[6] ..... B01F 11/00

[52] U.S. Cl. ..... 366/117; 366/124

[58] Field of Search ..... 366/108, 113, 366/114, 117, 118, 119, 120, 121, 122, 124, 276; 74/110

[56] References Cited

U.S. PATENT DOCUMENTS 3,410,534 11/1968 Wyczalek ..... 366/124 X
3,770,248 11/1973 Cahoon et al. ..... 366/117

FOREIGN PATENT DOCUMENTS 2064099 7/1996 Russian Federation .

*Primary Examiner*—Charles E. Cooley
*Attorney, Agent, or Firm*—Ostrolenk, Faber, Gerb & Soffen, LLP

[57] ABSTRACT

A pneumatic vibrator having reduced noise levels is provided with an exhaust chamber in a baseplate thereof. The exhaust chamber is limited by walls of the baseplate, a bushing, and the outer surface of a hollow elastic element. The elastic element is a truncated cone, the smaller base of which firmly encompasses a bushing around a tie element, while the larger base bears against the baseplate. The exhaust chamber is in communication with an above-membrane chamber via a central through duct. The above-membrane chamber connects with the atmosphere by radial ducts in the cover of the baseplate, in which an annular collector is made, communicating with the radial ducts. The flow area of each of the ducts is less than the flow area of the collector. Coaxial axial ducts made in the cover and in the baseplate communicate with a second annular collector made in the baseplate and exhaust air to the atmosphere.

20 Claims, 4 Drawing Sheets

PNEUMATIC VIBRATOR

TECHNICAL FIELD

The invention relates to vibratory engineering, and more exactly to the pneumatic class of vibrators.

The present invention can most successfully be used in the production of aluminum by electrolysis in order to feed material into an electrolyzer with a tool performing vibrational and reciprocal motion.

BACKGROUND ART

At present different devices for locally feeding alumina into electrolyzers, including devices using pneumatic vibrators, are being developed in order to intensify the process of production of aluminum and to improve the ecology. Such mechanisms operate under conditions of a high content of abrasive particles in the atmosphere and high temperatures accompanying the production of aluminum. This production is characterized by a large number of electrolyzers concentrated in one building, typically about 100 units, and the number of service mechanisms feeding the alumina to those electrolyzers reaches 300–400 units. The main requirements to which the vibrators being developed should conform are high reliability of their operation under the aforesaid conditions, efficiency and low noise level.

Attempts to improve the reliability of the operation of a vibrator operating in the production of aluminum resulted in the development of the vibrator according to Russian patent No. 2064099 comprising a box-like housing with a base and first cover, inside which housing a baseplate is disposed is a spaced manner around the perimeter and coaxial with the vertical central axis. This plate is freely mounted on compression springs bearing against the base having a central aperture. A central aperture is also made in the baseplate coaxially with that aperture. The baseplate is closed from above with a second cover limiting its inner space. The inner space, by means of a first elastic membrane, restrained along the perimeter between the plate and the second cover, is divided into an under-membrane chamber, communicating with a source of compressed air, and an above-membrane chamber. A disk-shaped support element is positioned in the above-membrane chamber in contact with the first elastic membrane having a central through aperture coaxial with the central axis of the housing. By means of a first duct the above-membrane chamber is constantly in communication with the atmosphere. A tie element at one end bears against the disk-shaped support element, while the other end extends beyond the housing and has a radial through aperture, serving for its rigid connection by means of a wedge-shaped element to a first bushing encompassing the tie element and having corresponding apertures for such a connection, to a second bushing and the disk-shaped support element, which are positioned coaxially on the tie element. The second bushing encompassing the tie element passes through the central aperture of the first elastic membrane and carries an elastic valve element serving for interaction with a valve seat made in the baseplate. A return compression spring is provided, with one end bearing against the baseplate, the other against the flange of the first bushing serving to secure the working tool for feeding material into the electrolyte. A pneumatic chamber is provided to provide the tool with translational motion toward the electrolyte and back therefrom. The pneumatic chamber is disposed in the housing and communicates with the source of compressed air and the atmosphere, and is limited by the cover of the housing and a second elastic membrane restrained along the periphery between the cover of the housing and the housing and bearing against the cover of the baseplate.

This construction of the vibrator provides for its operation under conditions with the presence of abrasive particles in the atmosphere, since there is no friction between the baseplate and the second bushing, nor between the housing and the first bushing connected to the working tool for pushing alumina into the electrolyte. Furthermore, the massive vibrating baseplate is well vibration-insulated from the housing which prevents destruction of the anode shell.

However, operation of the vibrator is accompanied by a high noise level, up to 85–95 db, due to free discharge of spent compressed air therefrom into the atmosphere. Furthermore the vibrator has a reduced efficiency due to overcoming the resistance of air to movement of the first elastic membrane in the above-membrane chamber.

The power of the vibrator in the construction described above has a limited value due to the sticking of the elastic valve element on the valve seat when the pressure in the under-membrane chamber is increased, which often results in a stoppage of the working tool when the load on the working tool increases in the zone of input of alumina into the electrolyte.

SUMMARY OF THE INVENTION

An object of the invention is to increase the efficiency of the vibrator in accordance with the invention.

Another object of the present invention is to improve the conditions of operation of the personnel servicing the electrolyzer by reducing the level of the noise produced by the vibrators.

One more object of the invention is to increase the power of the vibrator in accordance with the invention with improved reliability of operation.

In accordance with the foregoing and other objects the essence of the present invention is that an exhaust chamber is provided in a baseplate, is limited by walls of the baseplate and a second bushing and by the outer surface of a hollow elastic element made in the form of a truncated cone, the smaller base of which firmly encompassing the second bushing, the larger base bearing against the baseplate, and the exhaust chamber is in communication with an above-membrane chamber via a second duct.

The second duct preferably can be formed by a first radial through duct made in the second bushing and with one end in communication with the exhaust chamber. The other end is in communication with an annular collector made in the aforesaid second bushing and in communication with inlet ends of second radial through ducts made in the tie element coaxially with the first radial ducts and in communication at the outlet ends with a blind axial space made in the aforesaid tie element and communicating with the aforesaid above-membrane chamber.

It is preferred that the first duct for communication of the above-membrane chamber with the atmosphere be formed by radial ducts in the cover of the baseplate in which an annular collector is made communicating with the aforesaid radial ducts, the flow area of each of which is less than the flow area of the collector, which by means of coaxial axial ducts made in the cover and in the baseplate would be in communication with a second annular collector made in the baseplate and communicating with the atmosphere.

The above-described construction of the vibrator ensures enhancement of its efficiency. This is due to the presence of an exhaust chamber, the energy of the spent air of which is used to change the character of the mechanical oscillations of the working tool in the zone of input of material into the electrolyte, in particular, the speed of its movement downwards increases approximately two times, which promotes more intensive pushing of the loose material into the electrolyte, while the speed of its movement upwards is slowed down, which increases the efficiency of the process of heat exchange between particles of the material in a vibrofluidized state and the tool heated while it is in the lower phase of its translational motion and with anode gases.

Thus, a change in the character of mechanical oscillations of the working tool results in an increase of the carrying capacity of the material input zone without an increase in additional power consumption.

During operation of the vibrator in accordance with the invention, working conditions of personnel servicing the electrolyzer are improved due to a reduction of the level of the noise produced by the electrolyzer.

This is due to the structural realization of the first duct ensuring discharge of the spent compressed air from the exhaust chamber into the atmosphere and changing the propagation front of the sound wave, which reduces the amplitude of sound pressure.

It is recommended that a porous material bearing on the inner wall of the second cover be arranged in the above-membrane chamber in the zone of the input apertures of the radial ducts in the cover of the baseplate. This to an even greater degree improves the sanitary conditions in the electrolysis plant due to absorption of the energy of the sound wave in the volume of the porous element.

The use of a porous element reduces the noise level of the spent compressed air emanating from the vibrator by 20 db and turns its flow into a practically uniform efflux. Furthermore, the proposed noise suppression device, creating substantial resistance to the movement of the first elastic membrane upwards, slows down the return of the working tool to the upper dead center of the mechanical oscillations, which promotes a more intensive heat exchange between the particles of the material which are in a vibrofluidized state with the vibrating tool heated in the lower phase of the translational motion and with hot anode gases of the under-bell space.

A ring having radial notches along its lesser diameter and secured on the second cover can be provided to hold the noise suppression element of porous material pressed against the wall of the second cover.

The proposed attachment of the noise suppression element is simple during production and reliable in operation.

In order to protect the elastic elements of the vibrator—the first membrane, the valve element and the cone-shaped element limiting the exhaust chamber—from the effect of hot gases released during electrolysis, a cup is provided which is mounted in the baseplate and faces with its open end toward the elastic valve element, has a through aperture made at the bottom thereof coaxial with the central axis of the baseplate, and the cavity of the cup is filled with heat-resistant material.

The elastic valve element in the zone of its interaction with the seat is reinforced, preferably with a solid element which may be made in the form of a ring disposed inside the peripheral part of the elastic valve element.

The elastic valve element alternatively may be reinforced from two sides with rings attached to each other, wherein the lower ring should have a smaller diameter and should be shifted toward the second bushing to such a degree that a section would be free from the lower ring and interacting with the valve seat.

The upper reinforcing ring in a radial cross section can have an L-shaped form and encompass with the lesser shelf the peripheral end of the elastic valve element.

Reinforcement of the elastic valve element in the zone of its interaction with the seat also may be made in the form of a rim having a sealing belt on the surface facing the seat of the valve.

The reinforced peripheral part of the elastic valve element excludes its sticking to the seat under any industrial pressures of compressed air, since in that case the moment of tearing it from the seat practically coincides with the moment of the beginning of its contact with the aforesaid support flange of the second bushing. The use of a valve element with a rigid peripheral part makes it possible to substantially increase the power of the vibrator by increasing the pressure of the compressed air applied thereto and change it over wide limits. Simultaneously the reliability of switching the compressed air in the under-membrane chamber with the valve tool of the vibrator is enhanced over a wide range of frequencies, ensuring precise and stable operation of the vibrator.

BRIEF DESCRIPTION OF THE DRAWINGS

Other objects and advantages of the invention will become more clear from the following concrete examples of realization and the drawings in which.

DETAILED DESCRIPTION OF THE INVENTION

Figure 1:
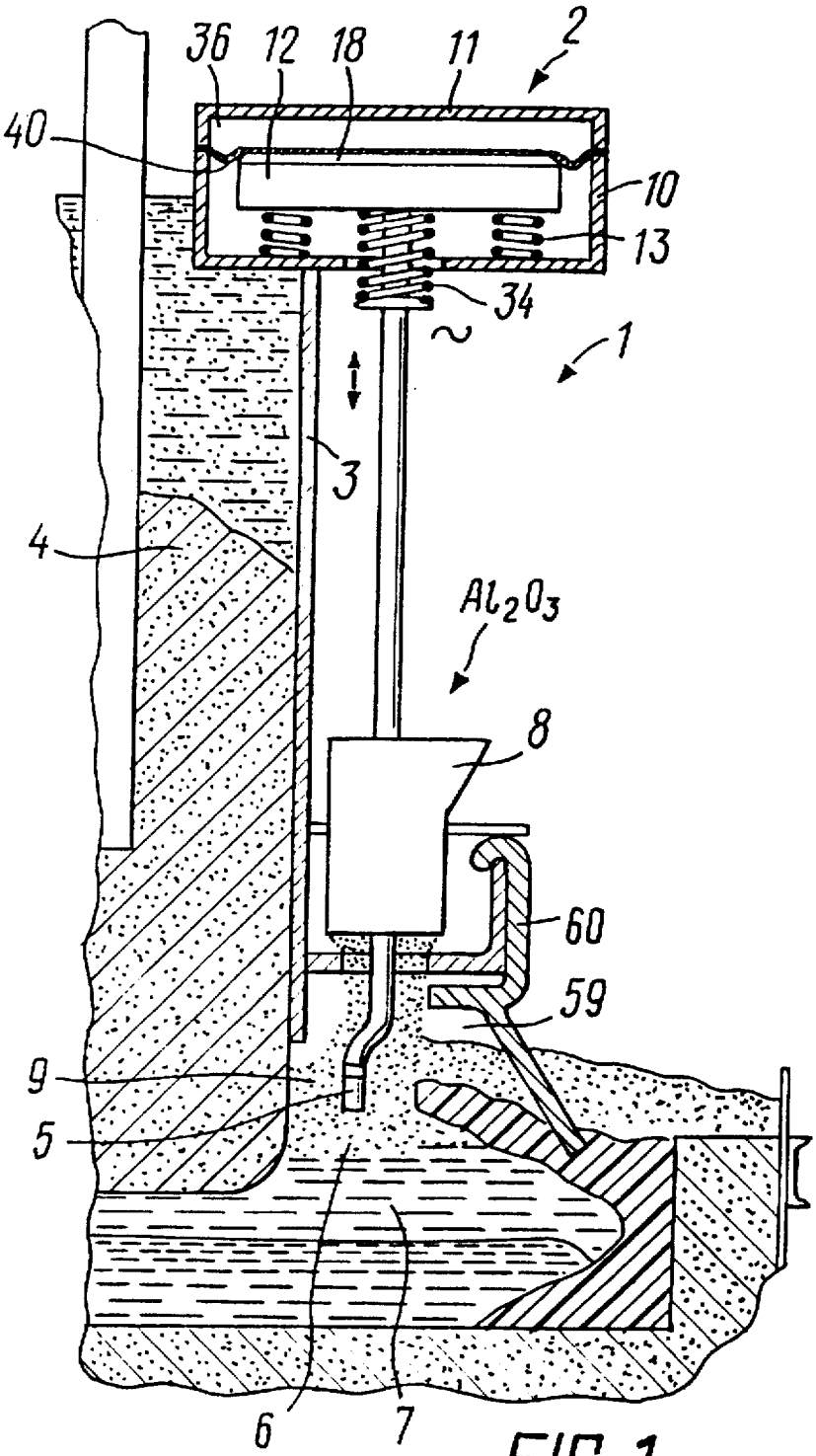
FIG. 1 shows schematically a device for feeding material into electrolyte in which electrolysis of aluminum takes place, with a vibrator, in accordance with the invention.

The vibrator in accordance with the invention can successfully be used in the device 1 (FIG. 1) for inputting loose material into an electrolyzer for the production of aluminum. A vibrator 2 is secured to a housing 3 of an anode 4, is connected to a tool 5 and ensures translation of the tool into a zone 6 of input of loose material into electrolyte 7, the loose material being fed from a receiving device 8, and also ensures oscillatory movement producing a vibrofluidized bed 9 of the material.

The vibrating tool 5, making frequent immersions into the layer of loose material ensures its effective mixing and pushing into the electrolyte 7, increases the carrying capacity of the material input zone 6 and ensures a uniform and high speed supply of it into the melt of electrolyte 7.

The vibrator 2 (FIG. 2) comprises a box-like housing with a base 10 and a first cover 11. A baseplate 12, freely mounted on compression springs 13 bearing against the base 10, is disposed inside the housing spaced along the perimeter and coaxial to the vertical central axis. Sockets 14, made on the plate 12 from the side facing the tool 5 (FIG. 1), and locks 15 (FIG. 2) made on the base 10 are provided to prevent turning of the baseplate 12 and for its fixation relative to the base 10. The base 10 has a central aperture 16 which is coaxial to the central aperture 17 made in the baseplate 12. The baseplate 12 is closed by a second cover 18 limiting the inner space of the plate 12, which space by means of a first elastic membrane 19, restrained along the perimeter between the baseplate 12 and the second cover 18, is divided into an under-membrane chamber 20, in communication with a source 22 of compressed air by means of a duct 21, and an above-membrane chamber 23. A disk-shaped support element 24, contacting the first elastic membrane 19, is disposed in the above-membrane chamber. The first elastic membrane 19 has a central through aperture 25 coaxial with the central axis 0—0 of the baseplate 12 and in continuous communication with the atmosphere via a first duct 26.

Figure 2:
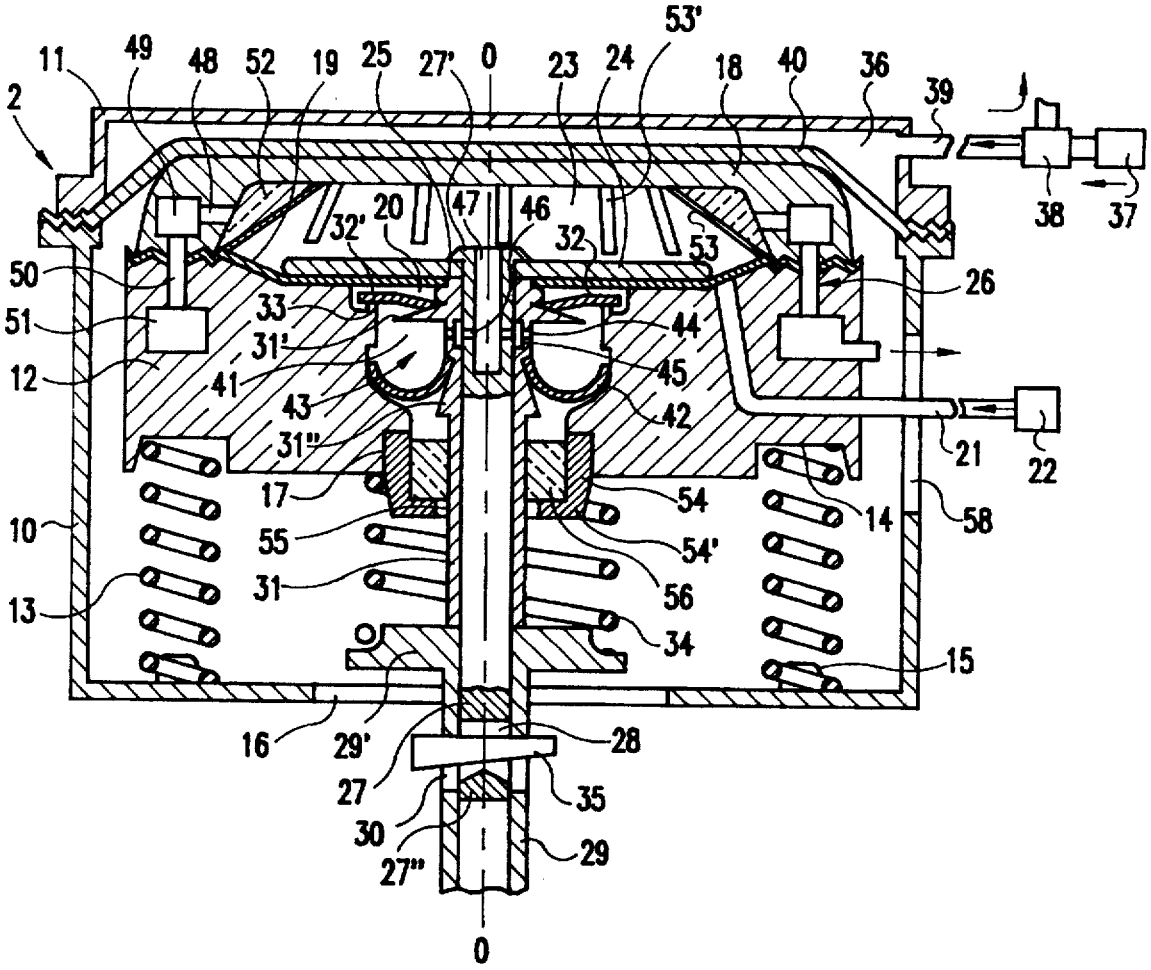
FIG. 2 shows a vibrator, in accordance with the invention, in section.

A tie element 27 (FIG. 2) is provided to transmit oscillatory movement to the working tool 5 (FIG. 1) in the zone 6 of material input into the electrolyte 7. One end of the tie element 27' bears against the disk-shaped support element 24, while the other free end 27" extends outside the housing and has a radial through aperture 28. A first bushing 29 is provided in order to rigidly secure the working tool 5 (FIG. 1) on the tie element 27 (FIG. 2). The bushing 29 has a flange 29' facing the baseplate 12, encompasses the tie element 27 in the zone of the through aperture 16 of the housing base 10 and has two diametrically opposed radial through apertures 30, the axes of which are shifted relative to the axis of the through aperture 28 of the tie element 27 towards its free end 27". Furthermore, a second bushing 31 is provided which encompasses the tie element 27, is disposed between the flange 29' of the first bushing 29 and the disk-shaped support element 24, passes through the central aperture 25 of the first elastic membrane 19 and carries an elastic valve element 32 which is designed for interaction with a seat 33 of the valve.

The elastic valve element 32 is a hollow truncated cone-shaped element, the larger base of which faces the first membrane 19, the smaller base being firmly set on the second bushing 31 in which an annular slot is made, the walls of which hinder displacement of the valve element 32. A support flange 31', having the purpose of supporting the conical surface of the valve element 32 when it is detached from the seat 33, is made below the annular slot on the surface of the bushing 31.

Before the vibrator is activated, the elastic element 32 interacts with the valve seat 33 made in the baseplate 12, whereby, as is evident from FIG. 2, the under-membrane chamber 20 is isolated from the ambient medium. A return compression spring 34 at one end bears against the baseplate 12, the other end bearing against the flange 29' of the first bushing 29. A rigid connection between the first bushing 29, the second bushing 31, the disk-shaped support element 24 and the tie element 27 is obtained by means of a wedge-shaped element 35 disposed in the through aperture 30 of the first bushing 29 and in the through aperture 28 of the tie element 27.

A pneumatic chamber 36 (FIG. 2) disposed in the housing is provided to impart translational motion to the tool 5 (FIG. 1) in the direction toward the electrolyte 7 and back therefrom. The pneumatic chamber communicates with a source 37 of compressed air via a three-way pneumatic valve 38, alternately connecting the pneumatic chamber 36 to the source 37 of compressed air and to the atmosphere along a pipe 39. The aforesaid chamber 36 is limited by the first cover 11 of the housing and a second elastic membrane 40, restrained along the periphery between the cover 11 of the housing and the base 10 of the housing, bearing against the cover 18 of the baseplate 12. An exhaust chamber 41 is provided in the baseplate 12, which chamber is limited by the walls of the baseplate 12 and the second bushing 31, by the valve element 32 and an elastic element 42 made in the form of a truncated cone, the smaller base of which firmly encompasses the second bushing 31, while the larger base bears against the baseplate 12.

Figure 4:
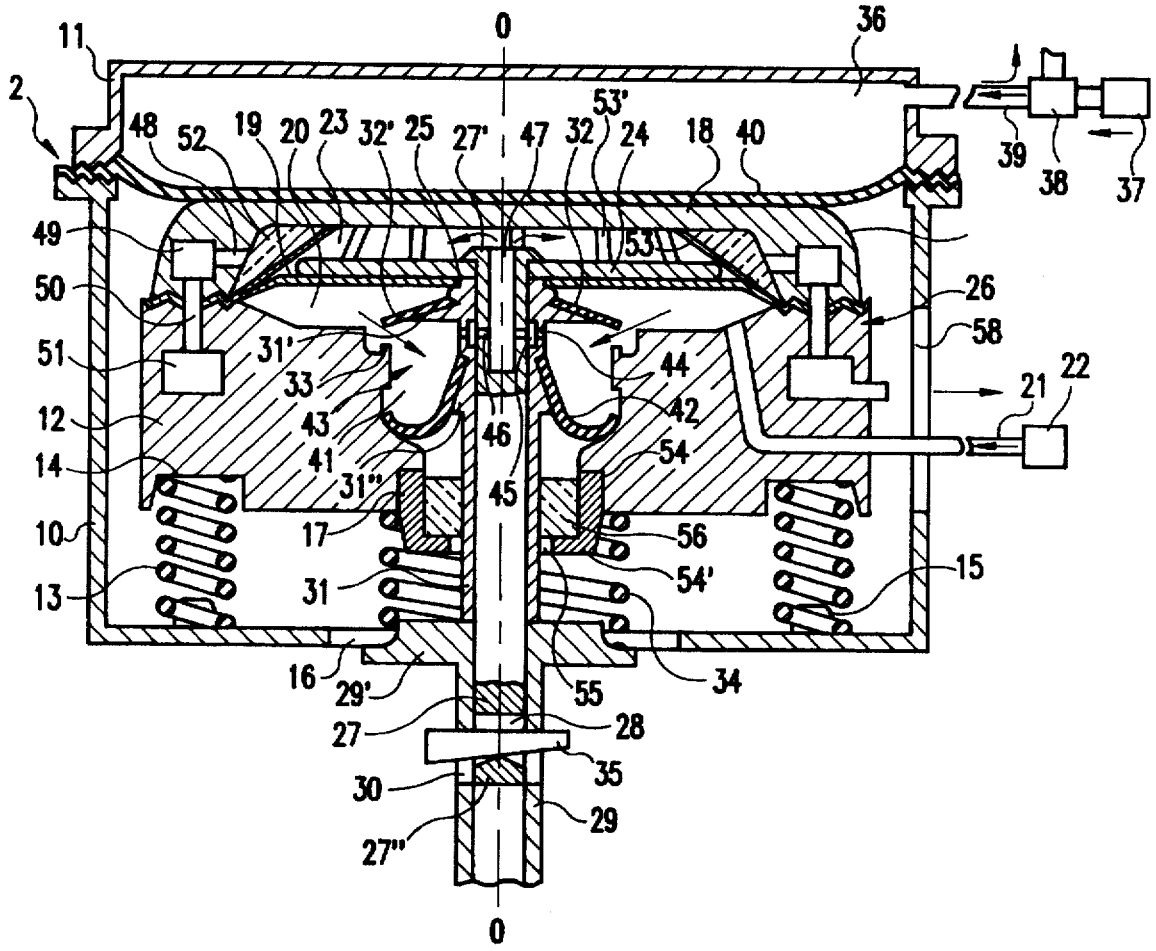
FIG. 4 shows a vibrator, in accordance with the invention, in the exhaust phase.

The bushing 31 in the zone in which the element 42 is secured thereto has a conical section 31" with the larger base thereof facing in the direction away from the exhaust chamber 41, the section 31" preventing slipping of the elastic element 42 from the bushing 31 when a positive pressure appears in the chamber 41 (FIG. 4) during operation of the vibrator.

The chamber 41 (FIG. 2) communicates via a second duct 43 with the above-membrane chamber 23.

The second duct 43 is formed by radial apertures 44 and a collector 45, which are made in the second bushing 31, by radial apertures 46 and an axial duct 47, which are made at the end 27' of the tie element 27, wherein the axial duct 47 communicates with the above-membrane chamber 23.

The first duct 26 for communication of the chamber 41 with the atmosphere is formed by radial ducts 48 in the cover 18 of the baseplate 12, in which an annular collector 49 is made which is in communication with the aforesaid radial ducts 48, the flow section of each of which is less than the flow section of the collector 49 which by means of coaxial axial ducts 50 made in the cover 18 and in the baseplate 12 communicates with a second annular collector 51 which is made in the baseplate 12 and communicates with the atmosphere. A sound-absorbing element 52 made of a porous material and resting on the inner wall of the second cover 18 is disposed in the above-membrane chamber 23 in the zone of the inlet apertures 48 of the first duct 26. A cone-shaped steel ring 53, secured to the second cover 18 and having radial notches 53' along the smaller diameter, is provided to hold the sound-absorbing element 52 pressed to the wall of the second cover 18. A cup 54 with its open end facing the elastic element 42 is mounted in the baseplate 12. A through aperture 55, coaxial with the central axis 0—0 of the baseplate 12, is made in the bottom 54' of the cup 54. The cavity of the cup 54 is fined with heat-resistant material 56. Use of heat-resistant material protects the elastic elements of the vibrator, in particular, the first membrane 19, the valve element 32 and the cone-shaped element 42, limiting the exhaust chamber 41, against the action of hot gases released during electrolysis.

Figure 3:
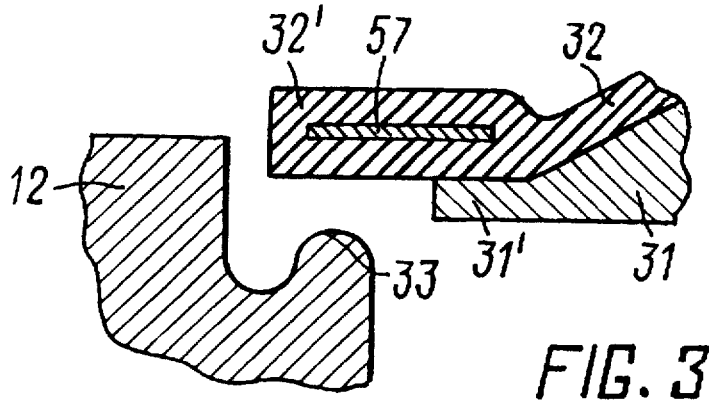
FIG. 3 shows an elastic valve element in the zone of its interaction with a seat, in accordance with the invention, a radial section in magnified scale.

The elastic valve element 32 in the zone of its interaction with the seat 33 is reinforced with a hard metal ring 57 (FIG. 3) disposed inside the valve element 32. Rigid realization of the peripheral part 32' of the elastic valve element 32 excludes its sticking on the seat 33 under any industrial pressures of compressed air in the under-membrane chamber 20, since therewith the moment at which it is detached from the seat 33 in practice coincides with the moment at which contact between the aforesaid peripheral part 32' and the support flange 31' of the second bushing 31 begins. Such a structural realization of the elastic valve element 32 with a rigid peripheral part 32' results in an increase in the power of the vibrator due to an increase of the pressure of the compressed air fed into the chamber 20 and to the possibility of changing it (the power) over a wide range, which improves the reliability of material input into the electrolyte 7 (FIG. 1). Furthermore, this expands the frequency range of the mechanical oscillations of the tool and improves the starting characteristics of the vibrator, i.e. ensures the reliable occurrence of self-excited oscillations, even when the working tool 5 is under a substantial load.

An aperture 58 is made in the side wall of the housing base 10 for the passage of the pipe 21 (FIG. 2).

The vibrator in accordance with the invention operates in the following manner. Compressed air from the source 22 (FIG. 4) is fed along the pipe 21 into the under-membrane chamber 20, creating therein a positive pressure, due to which a lift force is produced which, acting on the first elastic membrane 19, moves it upward in the direction away from the baseplate 12. The membrane 19 moves in the same direction the disk-shaped support element 24, tie element 27, second bushing 31, first bushing 29 with the working tool 5 (FIG. 1), which are rigidly connected to each other and form a single unit, overcoming the compression force of the spring 34 (FIG. 4) and the pull of gravity of the aforesaid elements 24, 27, 31, 29 and 5 of the rigid unit, wherewith the flange 29' of the first bushing 29 even more compresses the spring 34 in which accumulation of potential energy takes place. Upon further movement of the elements of the unit, interaction of the support flange 31' of the second bushing 31 with the elastic element 32 takes place, as a result of which the latter is detached from the seat 33 and communication of the under-membrane chamber 20 with the exhaust chamber 41 takes place (FIG. 4), which results in a sharp drop of the pressure in the chamber 20 and in displacement of the unit in the direction toward the electrolyte 7 due to the effect of the potential energy of the spring 34 and the pull of gravity. The spent compressed air from the exhaust chamber 41 via the second duct 43, in particular, radial ducts 44, collector 45 of the second bushing 31 and radial ducts 46 and axial duct 47 in the tie element 27, enters the above-membrane chamber 23, and from there exits through the first duct 26 into the atmosphere. Upon further movement of the unit downward in the direction toward the electrolyte 7, the elastic element 32 settles on the seat 33, isolating the chamber 20 from chamber 41. Since the chamber 20 is continuously connected to the source 22 of compressed air, the cycle of movement of the unit is repeated, ensuring stable self-excited mechanical oscillations of the working tool 5.

A reduction of the noise level of the spent compressed air, for example by 20 db, takes place in the chamber 23 due to the presence of the porous element 52. Then the spent air, passing through the radial ducts 48, collector 49, axial duct 50, collector 51, in practice uniformly and silently, is emitted from the vibrator into the atmosphere. Communication of the exhaust chamber 41 with the above-membrane chamber 23 and the presence of a porous sound-absorbing element 52 in that chamber result in a substantial change in the form of oscillatory movement of the tool 5, in particular, movement of the tool 5 downward toward the electrolyte 7 takes place substantially faster than its movement in the direction away from the electrolyte 7. The slower movement of the unit upwards is due to the increased resistance to air movement through the porous element 52, which promotes more intensive heat exchange between the material particles, which are in a vibrofluidized state, and the tool 5 and hot anode gases of under-bell space 59 limited by a gas-collecting bell 60. See FIG. 1. And the more rapid movement of the unit with the tool 5 toward the electrolyte 7 takes place due to an increase of the pressure in the above-membrane chamber 23 as a result of its communication with the chamber 41. This results in an increase of the kinetic energy of the tool 5, as a consequence of which the process of pushing the loose material to the electrolyte 7 is intensified.

Thus, a change in the character of mechanical oscillations of the working tool 5 results in an increase of the carrying capacity of the material input zone 6 without an increase in the consumption of compressed air.

In order to ensure translational movement of the vibrating tool 5 in the direction toward the electrolyte 7, compressed air from the source 37 of compressed air enters the chamber 36 through the pneumatic three-way solenoid valve 38. The force developed by the pressure of the compressed air in that chamber acts on the second elastic membrane 40, and it, overcoming the compression force of the springs 13, moves the second cover 18, membrane 19, baseplate 12 and connected thereto tool 5 which pushes the material in the input zone 6 to the electrolyte 7. After that the tool 5 moves in the direction away from the electrolyte 7 to charge a new portion of loose material into the input zone 6. For this, the chamber 36 is, by means of the valve 38, disconnected from the source 37 and made to communicate with the atmosphere. Then, due to the effect of the force developed by the spring 13, the baseplate 12 and connected thereto elements return to the initial position.

Then the cycle of translational movement for pushing the next portion of loose material is repeated.

Figure 5:
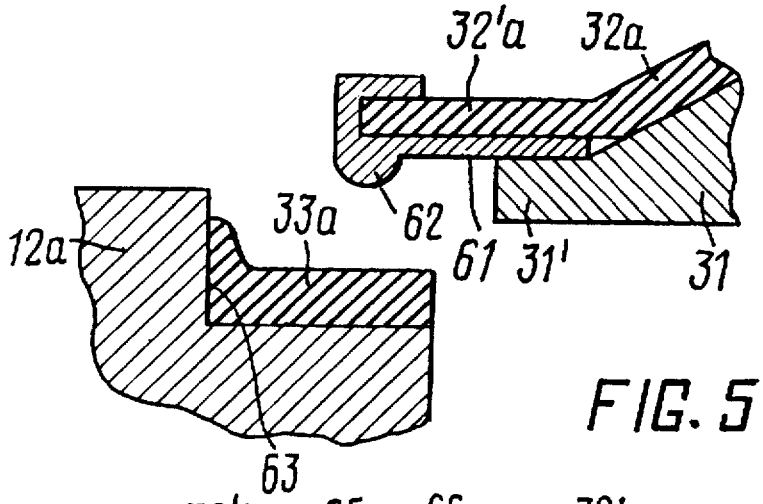
FIG. 5 shows a variant of realization of the elastic valve element, in accordance with the invention, a radial section, in magnified scale.

In another variant, in order to increase the service life of the valve unit under conditions of increased pressure, the peripheral part 32'*a* (FIG. 5) of the elastic valve element 32*a*, interacting with the seat 33*a*, is encompassed by a hard, primarily metallic, rim 61 which has a sealing belt 62 on the surface facing the seat 33*a*. Wherein the seat 33*a* is made of an elastic material, for example, rubber, and is an annular element mounted in an annular recess 63 of the baseplate 12*a*.

The vibrator in accordance with the invention operates in a manner similar to that described above. Such a structural realization of the valve unit simplifies the carrying out of repair work when the elastic material of the valve element and seat the break down. Furthermore, the valve unit described above is less expensive.

Figure 6:
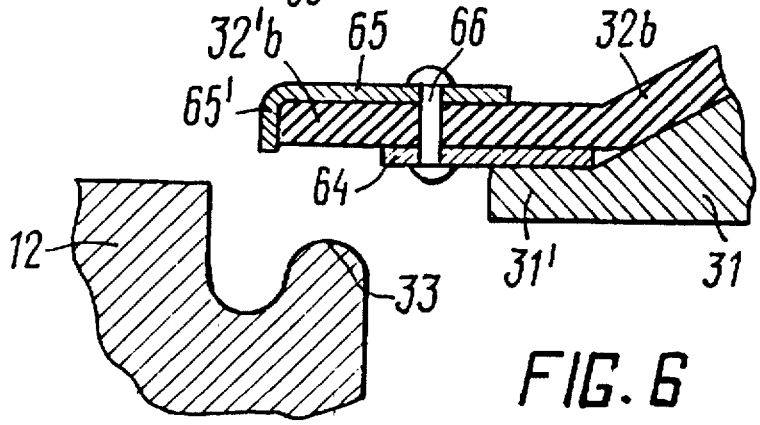
FIG. 6 shows a variant of realization of the elastic valve element, in accordance with the invention, a radial section in a magnified scale.

In another variant of realization of the vibrator in accordance with the invention, the valve unit in accordance with FIG. 6 is made in the following manner.

The peripheral part 32'*b* of the elastic valve element 32*b*, which part interacts with the seat 33, is reinforced on two sides with secured hard rings 64 and 65. The lower ring 64 is shifted toward the second bushing 31 to such a degree that a part is left which is free from the aforesaid lower ring and interacting with the seat 33 of the valve. The rings 64 and 65 are connected by means of, for example, rivets 66.

The upper reinforcing ring 65 in radial section has an L-shaped form and encompasses the peripheral part 32'*b* of the valve element 32*b* with a smaller shelf 65'.

The vibrator in accordance with the invention operates in a manner similar to that described above.

We claim:

1. A vibrator comprising:

a box-like housing having:

a base having a central aperture, a first cover attached to said base, a perimeter, and a vertical central axis, a plurality of compression springs disposed in said housing, each of said plurality of springs bearing at a first end against said base, a baseplate disposed coaxially to said vertical central axis of said housing, spaced within said perimeter of said housing, freely mounted on free second ends opposed to said first ends of said plurality of springs, and having a central aperture located coaxially to said central aperture made in said base, a wall of said baseplate limiting said central aperture of said baseplate, a second cover attached on said baseplate and limiting an internal space of said baseplate, a first elastic membrane restrained along said perimeter and between said baseplate and said second cover, and dividing said internal space of the baseplate into an above-membrane chamber and an under-membrane chamber having a central through aperture coaxial to said central aperture in said baseplate, a first source of compressed air in communication with said under-membrane chamber, a first duct serving for continuous communication between said chamber and the atmosphere, a disk-shaped support element, disposed in said above-membrane chamber, contacting said first elastic membrane and having a central through aperture coaxial with said central aperture of said baseplate, a tie element coaxially disposed in said central aperture of said baseplate and having two ends, one of said two ends passing through said through aperture of said disk-shaped support element and bearing thereon, the other free end extending outside said base of the housing and having a radial through aperture, a first bushing serving for attachment of a tool ensuring input of material into electrolyte, encompassing said tie element in the zone of said radial through aperture of said tie element and having two diametrically opposed through apertures, the axes of said opposed through apertures being shifted relative to the axis of said radial through aperture of said tie element in the direction of said free end of said tie element, a wedge-shaped element serving to form a single unit including said disk-shaped element, said tie element, said first bushings and a second bushing, and passing through said diametrically opposed through apertures of said first bushing and through said radial through aperture of said tie element, a flange made on said first bushing, a central compression spring, having one end bearing against said flange of said first bushing, the other opposing end bearing against said baseplate, a second bushing encompassing said tie element, disposed between said flange of said first bushing and said disk-shaped support element, and passing through said central through aperture of said first elastic membrane, a wall of said second bushing, a valve serving to reduce the pressure in said under-membrane chamber, a seat of said valve, the seat made in an upper part, facing said first membrane, of said baseplate along the periphery of said central aperture, an annular elastic element having an inner periphery firmly encompassing said second bushing, and an outer periphery interacting with said seat of said valve, a support flange made on said second bushing for supporting said elastic element in the direction of said central aperture, a cone-shaped section made in said second bushing, with its large base facing in the direction away from said support flange of said second bushing, an elastic sealing element made in the form of a hollow truncated cone, the smaller base of which firmly encompasses said second bushing, the larger base substantially sealing said central aperture of said baseplate, an exhaust chamber limited by said wall of said central aperture of said baseplate, an outer surface of said wall of said second bushing, said elastic valve element and said elastic element, a second duct serving for communication of said exhaust chamber with said above-membrane chamber and consisting of two sections, one of said sections made in said second bushing, the other of said sections made in said tie element, a second source of compressed air, a second elastic membrane restrained along the periphery between said first cover and said base of said housing and bearing against said second cover of the baseplate, and a pneumatic chamber serving to impart said tool with translational motion in the direction toward the electrolyte and back therefrom, the pneumatic chamber being limited by said first cover of the housing and said second elastic membrane and being alternately in communication with said second source of compressed air and the atmosphere.

2. A vibrator as claimed in claim 1, wherein one of said sections of said second duct which is made in said second bushing comprises:

a collector which is an annular turning made on said inner wall of the second bushing, and radial ducts made in said second bushing, each radial duct having one end communicating with said annular collector, the other of said sections of said second duct which is made in said tie element comprising:

a blind axial cavity, communicating with said above-membrane chamber, and radial ducts made in said tie element, each of which at one end communicates with said annular collector, at the other end with said blind axial cavity.

3. A vibrator as claimed in claim 2, wherein said first duct communicating said above-membrane chamber with the atmosphere comprises:

a first annular collector of said first duct, the first collector being made in the cover, redial ducts of said first duct which are in communication with said collector and with said above-membrane chamber, a second annular collector of said first duct, the second collector being made in said baseplate and in communication with the atmosphere, a plurality of first axial ducts of said baseplate at one ends in communication with said collector, a plurality of second axial ducts of said first duct, one ends of which are connected to said first collector, while the other ends are connected to the free ends of said first axial ducts.

4. A vibrator as claimed in claim 3, further comprising:

a sound-absorbing element made of a porous material, disposed in said above-membrane chamber in inlet apertures of the radial ducts of said first duct.

5. A vibrator as claimed in claim 4, further comprising:

a metal ring serving to hold said sound-absorbing element and having notches through the ring.

6. A vibrator as claimed in claim 5, further comprising:

a cup mounted in said baseplate and with its open side facing said elastic sealing element, a bottom of said cup, a through aperture coaxial with said central axis of said housing and made in said bottom of said cup, a heat-resistant material serving to protect said first membrane, valve element and cone-shaped elastic element against the action of hot gases released during electrolysis, and filling the cavity of said cup.

7. A vibrator as claimed in claim 6, further comprising:

a hard ring serving to reinforce said elastic valve element in a zone of interaction between said elastic valve element and said seats said hard ring being disposed inside said valve element.

8. A vibrator as claimed in claim 6, further comprising:

a hard rim encompassing said valve element in a zone of interaction between said valve element and said seat, and a sealing belt made on a surface of said hard rim and facing said seat.

9. A vibrator as claimed in claim 6, further comprising:

two hard rings, upper and lower, serving to reinforce said valve element from two sides in a zone of interaction between said valve element and said seat said lower ring shifted toward said second bushing to such a degree that a part of said valve element is left which is free from said lower ring and interacting with said seat of said valve.

10. A vibrator as claimed in claim 9, further comprising:

a peripheral end face of said valve element, said upper ring having an L-shaped form in radial section, and a smaller shelf of said L-shaped form encompassing the peripheral end face of said valve element.

11. A vibrator as claimed in claim 3, further comprising:

a cup having a cavity and being mounted in said baseplate with its open side facing said elastic sealing element, a bottom of said cup, a through aperture coaxial with the central axis of said housing and made in said bottom of said cup, and a heat-resistant material serving to protect said first elastic membrane, valve element and cone-shaped elastic sealing element against the action of hot gases released during electrolysis, and filling the cavity of said cup.

12. A vibrator as claimed in claim 1, wherein said first duct communicating said above-membrane chamber with the atmosphere comprises:

a first annular collector made in the second cover, radial ducts which communicate with said collector and with said above-membrane chamber, a second annular collector made in said baseplate and in communication with the atmosphere, a plurality of first axial ducts in said baseplate with ends communicating with said second collector, and a plurality of second axial ducts in said second cover, connected between said first collector and said first axial ducts.

13. A vibrator as claimed in claimed in claim 12, further comprising:

a sound-absorbing element made of a porous material, disposed in said above-membrane chamber in inlet apertures of said radial ducts of said first duct.

14. A vibrator as claimed in claim 13, further comprising:

a metal ring for holding said sound-absorbing element and having notches through the ring.

15. A vibrator as claimed in claim 1, further comprising:

a cup having a cavity and being mounted in said baseplate with its open side facing said elastic sealing element, a bottom of said cup, a through opening coaxial with the central axis of said housing and made in said bottom of said cup, and a heat-resistant material serving to protect said first elastic membrane, valve element and cone-shaped elastic sealing element from the action of hot gases released during electrolysis, and filling the cavity of said cup.

16. A vibrator as claimed in claim 1, further comprising:

a hard ring serving to reinforce said elastic valve element in a zone of interaction between said elastic valve element and said seat, said hard ring being disposed inside said valve element.

17. A vibrator as claimed in claim 1, further comprising:

a hard rim encompassing said elastic valve element in a zone of interaction between said elastic valve element and said seat, and a sealing belt made on a surface of said hard rim and facing said seat.

18. A vibrator as claimed in claim 1, further comprising:

two hard rings, upper and lower, serving to reinforce said valve element from two sides in a zone of interaction between said valve element and said seat said lower ring shifted toward said second bushing to such a degree that a part of said valve element is left which is free from said lower ring and interacting with said seat of said valve.

19. A vibrator as claimed in claim 18, further comprising:

a peripheral end face of said valve element, said upper ring having an L-shaped form in radial section, and a smaller shelf of said L-shaped form encompassing the peripheral end face of said valve element.

20. A vibrator comprising:

a housing having a central aperture;

an elastic membrane disposed within the chamber and defining two chambers, an above-membrane chamber open to ambient air, and an under-membrane chamber for receiving and releasing compressed air;

an elongated tie element within the inner housing, connected with the first elastic membrane, and extending outside the base of the housing, the tie element being spring-biased in a direction from within the inner housing toward the central aperture of the inner housing;

a valve serving to alternately open and close the under-membrane chamber in response to movement of the tie element;

an annular seal between the central aperture of the housing and the tie element, the seal defining an exhaust chamber separated from the under-membrane chamber by the valve, the exhaust chamber being alternately closed and opened to the under-membrane chamber by the valve, the exhaust chamber having an open air passage to the above-membrane chamber; and means for mounting the housing and for alternately forcing the housing in the spring-biased direction of the tie element and an opposite direction.

* * * * *